US006717089B1

(12) United States Patent
Azzola et al.

(10) Patent No.: US 6,717,089 B1
(45) Date of Patent: Apr. 6, 2004

(54) ELECTRIC POLE FOR LOW-VOLTAGE POWER CIRCUIT BREAKER

(75) Inventors: Lucio Azzola, Bergamo (IT); Eligio Zanchi, Alzano Lombardo (IT)

(73) Assignee: ABB Service S.r.l., Milan (IT)

( * ) Notice: Subject to any disclaimer, the term of this patent is extended or adjusted under 35 U.S.C. 154(b) by 0 days.

(21) Appl. No.: 10/089,607

(22) PCT Filed: Oct. 4, 2000

(86) PCT No.: PCT/EP00/09755

§ 371 (c)(1),
(2), (4) Date: Apr. 1, 2002

(87) PCT Pub. No.: WO01/27948

PCT Pub. Date: Apr. 19, 2001

(30) Foreign Application Priority Data

Oct. 8, 1999 (IT) ..... MI99A2114

(51) Int. Cl.[7] ..... H01H 3/00; H01H 53/00

(52) U.S. Cl. ..... 218/146; 335/6; 335/16; 335/147; 335/195

(58) Field of Search ..... 218/143, 146; 335/6–18, 185–204; 200/237, 302.1, 302.2, 302.3

(56) References Cited

U.S. PATENT DOCUMENTS 4,638,277 A * 1/1987 Thomas et al. ..... 335/195
4,727,345 A * 2/1988 Kugler et al. ..... 335/196
6,023,035 A * 2/2000 Azzola et al. ..... 218/7

FOREIGN PATENT DOCUMENTS

| | | |
|---|---|---|
| DE | A-41 03 584 | 8/1991 |
| EP | A-0 219 449 | 4/1987 |
| JP | 04-019938 A * | 1/1992 |
| WO | WO 01/27948 A1 * | 4/1991 |

* cited by examiner

*Primary Examiner*—James R. Scott
(74) *Attorney, Agent, or Firm*—Guido Modiano; Albert Josif; Daniel O'Byrne

(57) ABSTRACT

An electric pole for a low-voltage power circuit breaker, comprising:

a fixed contact and a movable contact which can be mutually coupled/uncoupled;

at least two conducting elements, suitable to electrically connect the movable contact to a power supply grid, the conducting elements being arranged so that the electric currents flowing through them are equally orientated;

means for mechanically supporting and actuating the movable contact; and at least one insulating element which is interposed between the conducting elements and is suitable to contrast, by friction with the conducting elements, electrodynamic repulsion forces that are generated between the fixed contact and the movable contact during opening in short-circuit operating conditions.

8 Claims, 4 Drawing Sheets

ELECTRIC POLE FOR LOW-VOLTAGE POWER CIRCUIT BREAKER

BACKGROUND OF THE INVENTION

The present invention relates to an electric pole for a low-voltage power circuit breaker having improved characteristics.

More specifically, the expression "low-voltage power circuit breaker" is used to designate a circuit breaker which is generally used in applications, e.g. industrial systems, characterized by operating voltages of less than 1000 volts and by electric currents, typically alternate currents, of relatively high nominal value, (from a few hundred to several thousand amperes), which accordingly produce relatively high power levels.

It is known that power circuit breakers, comprising one or more electric poles, are normally designated to ensure the electric current required by the various users, at the same time performing connection and disconnection of the load or protecting the load from abnormal events, due for example to overloads or to a short circuit, by automatically opening the circuit, or disconnecting the protected circuit by opening appropriately provided electric contacts in order to achieve complete isolation of the load with respect to the power supply grid.

Currently there are many embodiments of low-voltage power circuit breakers, according to the nominal current considered.

In general, however, for each electric pole the interruption of the current, be it a nominal, overload or short-circuit current, occurs by virtue of the separation of a movable contact and of a fixed contact.

An example of a contact arrangement for a low-voltage circuit breaker is described in the European Patent EP 0219449.

The typical structure of an electric pole for a low-voltage power circuit breaker is described with reference to FIG. 1. Said pole comprises a fixed contact 1 and a movable contact 2 which can be mutually coupled/uncoupled. The movable contact 2 is connected and arranged on a contact supporting shaft 4 which is generally made of insulating material and acts as a mechanical support and/or transmits the motion to the movable contact. In order to maintain electrical continuity while allowing the motion of the movable contact 2, a flexible conductor 3 is generally used which has the only task of ensuring the electrical connection between the movable contact 2 and a power supply grid, not shown in FIG. 1.

The movable contact 2, the flexible conductor 3 and the contact supporting shaft 4 are shown in greater detail in FIG. 2. In this case, the flexible conductor 3 is constituted by two flexible metal braids which are accommodated contiguously in a cavity of the contact supporting shaft. At the ends of the metal braids there are a flange 7 and a pivot 8, which are used respectively for connection to the power supply grid and to the movable contact.

In the operating condition for opening at nominal current, following an opening command, the movable contact 2 is moved at a specific speed by the contact supporting shaft 4, which is in turn actuated by an actuation mechanism, not shown in FIGS. 1 and 2.

In the operating condition for opening at short-circuit current, typically before the opening intervention performed by the actuation mechanism, separation of the electric contacts occurs due to the electrodynamic repulsion forces that arise between the movable contact and the fixed contact. For high short-circuit currents, such as those that affect low-voltage power circuit breakers (tens of kiloamperes), these electrodynamic repulsion forces reach values which impart a very high end-stroke velocity to the movable contact.

Due to the very high velocity at the end-stroke, it is necessary to provide, in order to stop the movable contact 2, appropriate arrester devices, for example an abutment plate 5, as shown in FIG. 1, and to give sufficiently sturdy dimensions to the entire kinematic opening system movable contact 2 and contact supporting shaft 4, so that it can withstand the intense stresses caused by the stroke end impact of the movable contact 2. To avoid this occurrence, it is necessary to provide the entire kinematic opening system so that intervention occurs in a relatively short time, particularly before the movable contact reaches the end of its stroke.

These design constrains of course entail a considerable increase in the manufacturing times and costs of the circuit breaker.

Furthermore, again due to the high velocity at the end-stroke, the movable contact might not stop at the abutment plate 5 but might bounce on it, coupling to the fixed contact again. This occurrence would be critical, since it would entail an unwanted closure of the contacts in the presence of fault conditions.

SUMMARY OF THE INVENTION

The aim of the present invention is to provide an electric pole for a low-voltage power circuit breaker which allows to limit to relatively modest values the end-stroke velocity of the movable contact during opening in short-circuit operating conditions.

Within the scope of this aim, an object of the present invention is to provide an electric pole for a low-voltage power circuit breaker in which it is possible to ensure the arresting of the movable contact during opening in short-circuit operating conditions without adopting particular arrester devices.

Another object of the present invention is to provide an electric pole for a low-voltage power circuit breaker which ensures the possibility to avoid unwanted reclosures of the electric contacts after opening in short-circuit operating conditions.

Another object of the present invention is to provide an electric pole for a low-voltage power circuit breaker which ensures the possibility to limit the required intervention speed of the kinematic opening system.

Another object of the present invention is to provide an electric pole for a low-voltage power circuit breaker which is highly reliable, simple to manufacture and at low cost.

This aim, these objects and others which will become apparent hereinafter are achieved by an electric pole for a low-voltage power circuit breaker, comprising:

- a fixed contact and a movable contact which can be mutually coupled/uncoupled;
- at least two conducting elements, suitable to electrically connect said movable contact to a power supply grid, said conducting elements being arranged so that the electric currents flowing through them are equally orientated; and
- means for mechanically supporting and actuating said movable contact;

The electric pole according to the invention is characterized in that it comprise at least one insulating element which is interposed between said conducting elements and contrasts, by friction with said conducting elements, electrodynamic repulsion forces that are generated between said fixed contact and said movable contact during opening in short-circuit operating conditions.

BRIEF DESCRIPTION OF THE DRAWINGS

Further characteristics and advantages of the invention will become apparent from the description of some preferred but non-limitative embodiments of an electric pole for a low-voltage power circuit breaker according to the invention, illustrated only by way of non-limitative example with the aid of the accompanying drawings, wherein.

DESCRIPTION OF THE PREFERRED EMBODIMENTS

Figure 1:
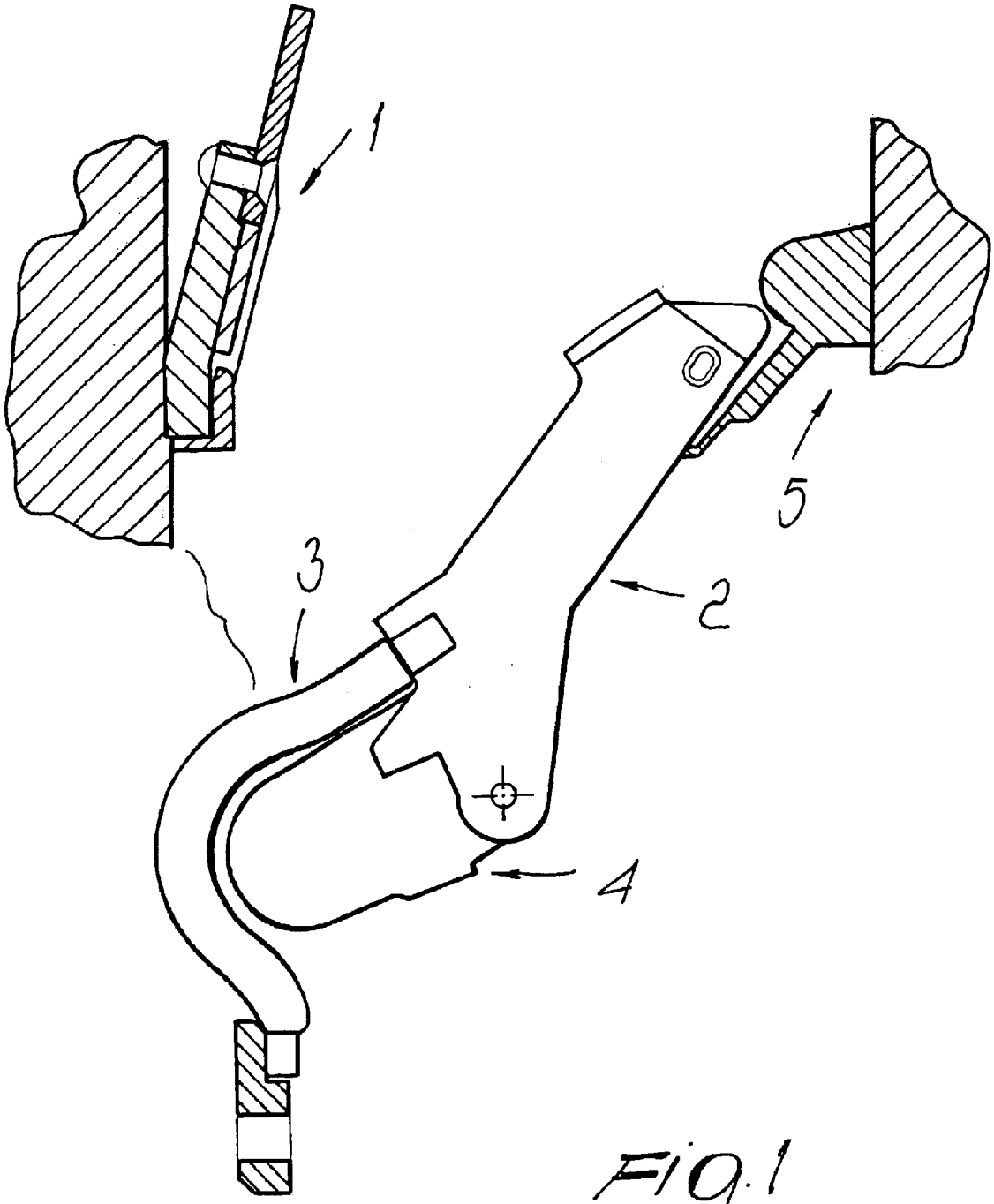
FIG. 1 is a schematic view of an electric pole for low-voltage power circuit breakers, having a known structure.
Figure 2:
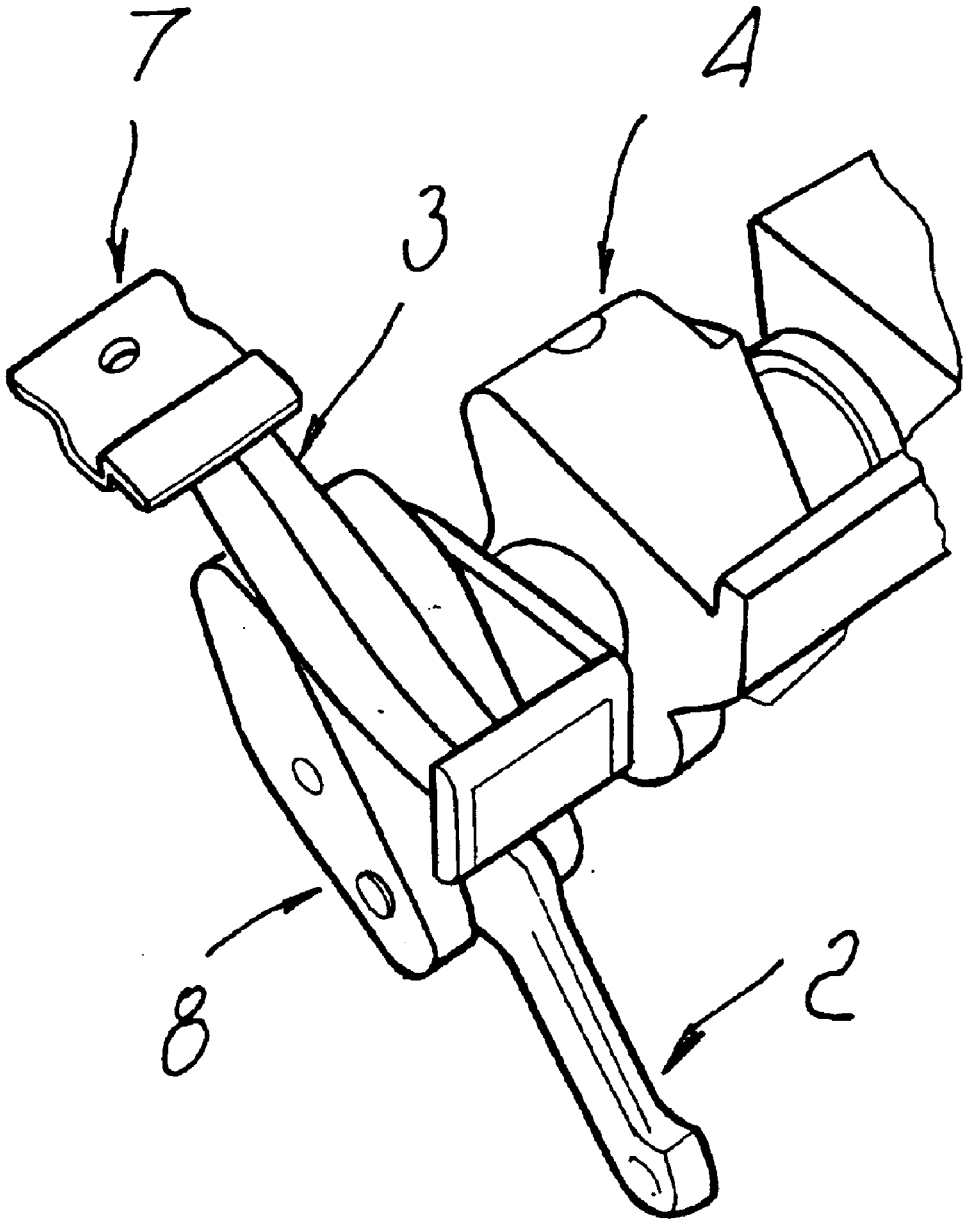
FIG. 2 is a perspective view of a constructive detail of the electric pole of FIG. 1.
Figure 3:
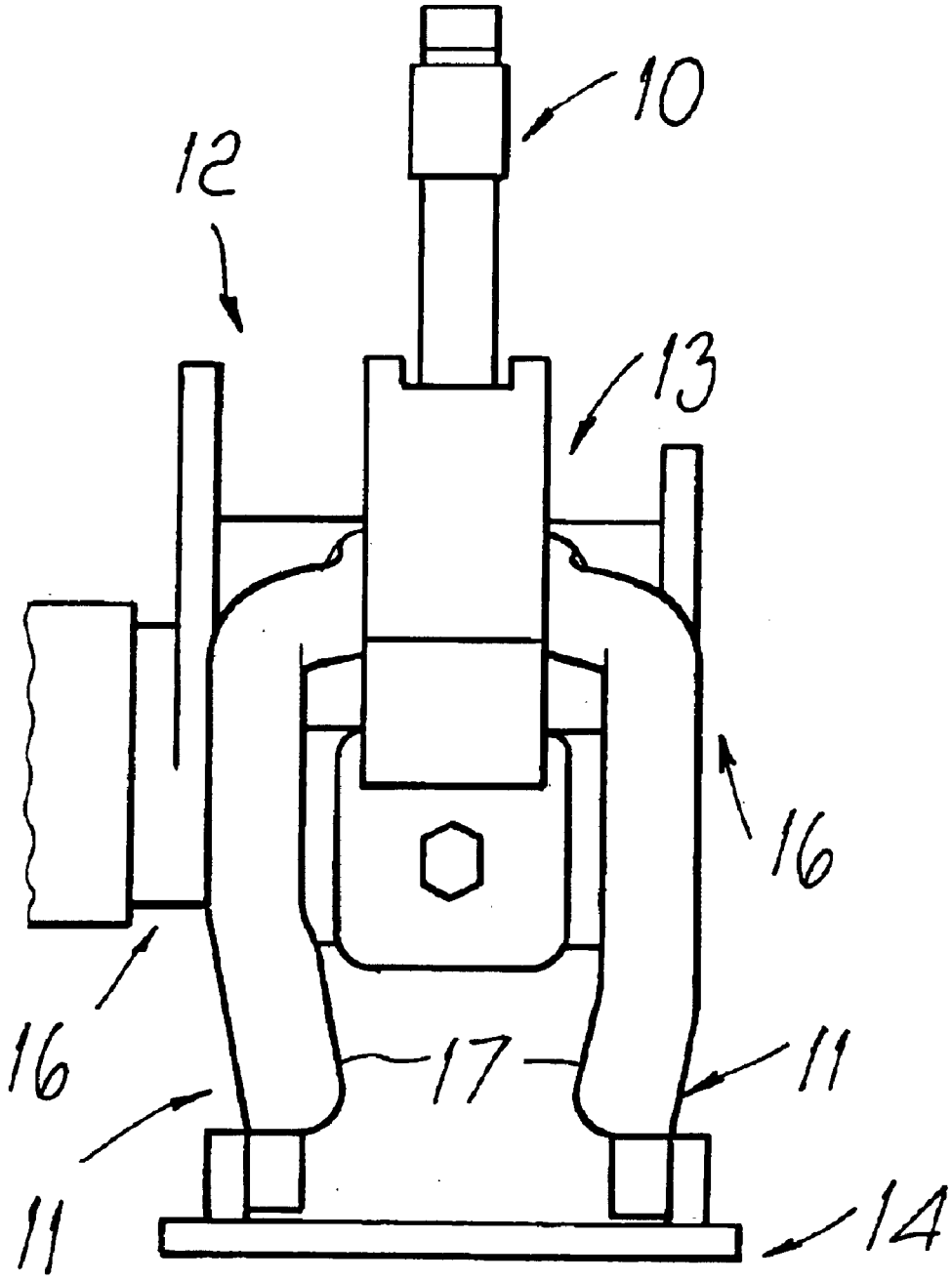
FIG. 3 is a schematic view of the structure of a first embodiment of the electric pole according to the invention.

With reference to FIG. 3, the electric pole according to the invention has a fixed contact, not shown in Figure, and a movable contact 10 which can be mutually coupled/uncoupled, and two or more conducting elements 11 for electrically connecting the movable contact 10 to a power supply grid, also not shown in FIG. 3. A particular characteristic of the conducting elements 11 is the fact that they are arranged so that the electric currents flowing through them are equally orientated. For example, according to a preferred embodiment shown in FIG. 3, the conducting elements 11 are constituted by a pair of flexible metallic braids which are connected in parallel to each other. This solution ensures that the flow of electric current occurs in the same direction in both conducting elements 11, for example in the direction indicated by the arrow 16.

Other embodiments are of course possible which may foresee, for example, the use of a larger number of conducting elements, provided that they are always arranged so as to be interested by equally orientated currents. Advantageously, the flexible metallic braids 11 of FIG. 3 comprise, at each end, means for providing connection respectively to the movable contact 10 and to the power supply grid. In the embodiment of FIG. 3, the means for connecting to the power grid are constituted by a connecting flange 14.

The electric pole according to the invention further comprises means 12 which are suitable to mechanically support the movable contact 10 and to transmit motion thereto; in particular, said means 12 comprise a contact supporting shaft 12 which is made of insulating material.

The electric pole according to the invention is characterized in that it comprises one or more insulating elements, designated by the reference numeral 13 in FIG. 3, which are interposed between the conducting elements 11.

For example, in the embodiment of FIG. 3 there is a single insulating element 13 which is arranged between the two parallel braids 11 and is operatively connected to the insulating shaft 12.

The essential function performed by the insulating element 13 is to contrast, by friction with the conducting elements 11, the electrodynamic repulsion forces generated between the fixed contact and the movable contact during opening in short-circuit operating conditions.

Since the conducting elements 11 are crossed by equally orientated currents, an electrodynamic attraction force, schematically indicated by the arrows 17 in FIG. 3, occurs between them. In short-circuit operating conditions, when the currents that flow through the conductors 11 reach high levels, the conducting elements 11 are attracted against the insulating element 13 interposed between them. The friction force that occurs between the conductors 11 and the element 13 contrasts the movement of the contact supporting shaft 12, rigidly coupled to the movable contact 10. In this manner, the friction force absorbs part of the energy with which the movable contact 2 separates from the fixed contact. The end-stroke velocity of the movable contact 10 is thus reduced so that it is below relatively modest limits. As the friction force between the insulating element 13 and the conductors 11 is directly proportional to the current that flows through the conductors, the force that contrasts the motion of the movable contact therefore becomes considerable for high current values, as in the operating conditions for opening at short-circuit current.

On the other end, in operating conditions for opening at nominal current, in view of the very low current values, the friction force does not assume significant values, thus not affecting in any way the opening movement.

Figure 4A:
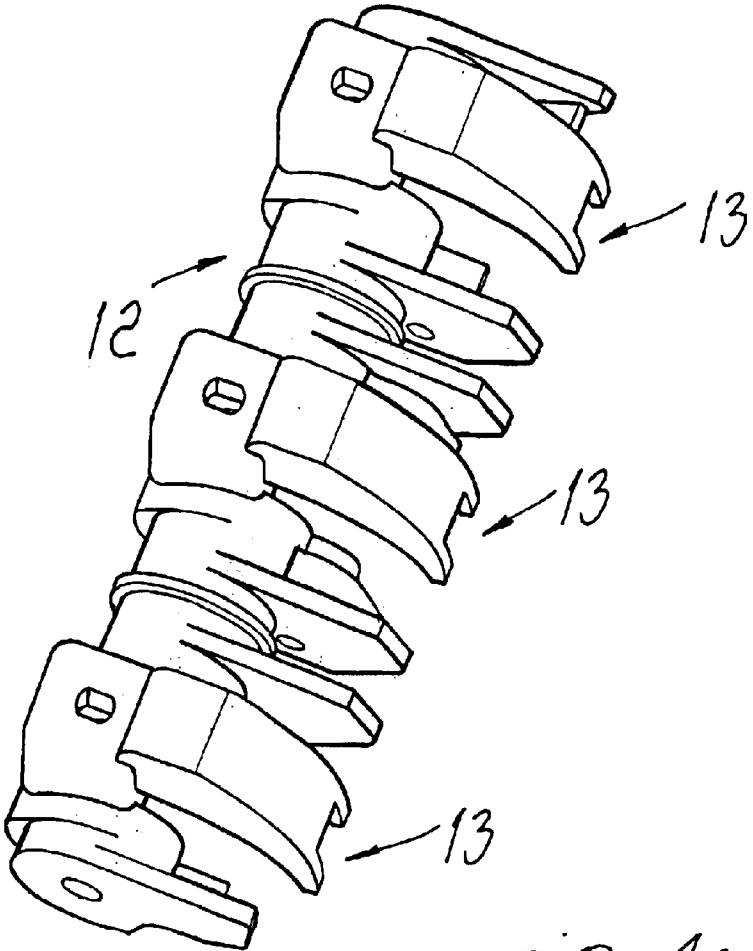
FIGS. 4*a* and 4*b* are two different perspective views of a constructive detail of the embodiment of the electric pole according to the invention, shown in FIG. 3.
Figure 4B:
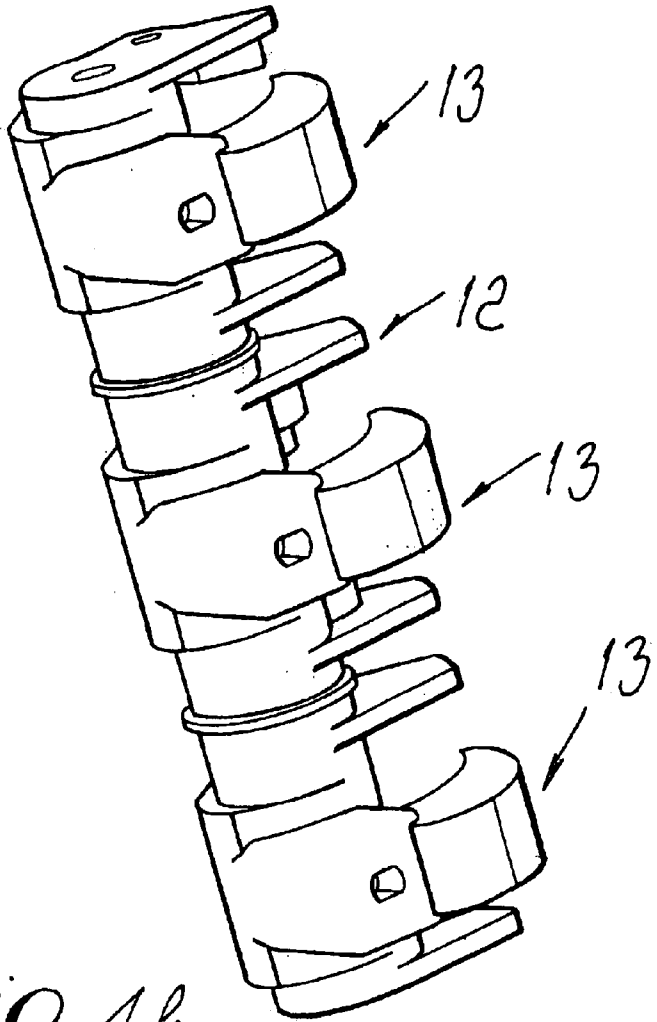

A preferred embodiment of the contact supporting shaft 12 and of the insulating element 13, particularly suitable for use in three-pole circuit breakers, are described with reference to FIGS. 4*a* and 4*b*.

In this case, three insulating elements 13, each of which corresponds to a movable contact (not shown) which belongs to a corresponding pole, are fixed to the contact supporting shaft 12.

As illustrated, each insulating element 13 comprises a body which, seen laterally, has two curved-shaped walls which are suitable to operatively interact with the corresponding conducting elements 11.

According to a solution which is structurally simple and functionally effective, the insulating elements are made of plastic material and are realized monolithically with the operating shaft 12.

In particular, the insulating elements 13 can be directly obtained from the contact supporting shaft 14, for example by means of an injection-molding process.

Alternatively, each insulating element 13 and the shaft 12 can be realized in two different pieces, suitably connected to each other; furthermore, each insulating element 13 could be operatively connected to other elements of the pole.

In practice it has been found that the electric pole according to the invention fully achieves the intended aim and objects.

In particular, by giving appropriate dimensions to the insulating elements and to the conducting elements, it is possible to determine, with reasonable approximation, the end-stroke velocity of the movable contact even during the operating conditions for opening at short-circuit current. It is therefore possible to set the dimensions of the electric pole according to the invention so that the end-stroke velocity is limited to a range of relatively small values, reducing the energy of the stroke limit impact and preventing the occurrence of unwanted reclosures of said contacts.

It is further possible to eliminate, or at least to significantly reduce, the arresters of the movable contact, which are commonly adopted in known types of circuit breaker.

The reduced end-stroke velocity of the movable contact allows to reduce the required intervention speed of the opening kinematic mechanism, thus relaxing the design constraints.

Finally, it has been observed that the adoption of the insulating elements does not entail in any way a significant increase in manufacturing costs, since said elements can be obtained directly from the contact supporting shaft. On the contrary, the possibility to eliminate the arresters of the movable contact and the possibility to simplify the opening kinematic mechanism of the circuit breaker entail a simplification in the manufacture of the circuit breaker, together with higher operating reliability.

The electric pole for a low-voltage power circuit breaker thus conceived is susceptible of modifications and variations, all of which are within the scope of the inventive concept; all the details may furthermore be replaced with technically equivalent elements. In practice, the materials used, so long as they are compatible with the specific use, as well as the dimensions, may be any according to requirements and to the state of the art.

What is claimed is:

1. An electric pole for a low-voltage power circuit breaker, comprising:

a fixed contact and a movable contact which can be mutually coupled/uncoupled;

at least two conducting elements, suitable to electrically connect said movable contact to a power supply grid, said conducting elements being arranged so that the electric currents flowing through them are equally orientated; and means for mechanically supporting and actuating said movable contact;

further comprising at least one insulating element which is interposed between said conducting elements and which contrasts, by friction with said conducting elements, electrodynamic repulsion forces that are generated between said fixed contact and said movable contact during opening in short-circuit operating conditions.

2. The electric pole according to claim 1, wherein said means for mechanically supporting and actuating said movable contact comprise a contact-supporting operating shaft made of insulating material.

3. The electric pole according to claim 2, wherein said insulating element is operatively connected to said operating shaft.

4. The electric pole according to claim 3, wherein said insulating element and said operating shaft are (realized monolithically) made in a single piece.

5. The electric pole according to claim 1, wherein said insulating element comprises a body made of plastic material which, seen laterally, presents two walls having a curved profile and being suitable to operatively interact with said at least two conducting elements.

6. The electric pole according to claim 1, wherein said at least two conducting elements are constituted by a pair of flexible metallic braids which are parallel-connected to each other.

7. The electric pole according to claim 6, wherein said flexible metallic braids comprise, at each end, means for connection respectively to said movable contact and to said power supply grid.

8. A low-voltage power circuit breaker, comprising at least one electric pole according to claim 1.

* * * * *